United States Patent [19]

George

[11] 4,082,542

[45] Apr. 4, 1978

[54] COPPER PRECIPITATE AGGLOMERIZATION PROCESS

[75] Inventor: David B. George, Salt Lake City, Utah

[73] Assignee: Kennecott Copper Corporation, New York, N.Y.

[21] Appl. No.: 796,972

[22] Filed: May 16, 1977

Related U.S. Application Data

[63] Continuation-in-part of Ser. No. 638,022, Dec. 5, 1975, abandoned.

[51] Int. Cl.[2] ..... C22B 15/14

[52] U.S. Cl. ..... 75/5; 75/7; 75/72; 75/91

[58] Field of Search ..... 75/3, 4, 5, 7, 72, 76, 75/89, 108, 90 R, 90 HP, 91

[56] References Cited

U.S. PATENT DOCUMENTS

| | | | |
|---|---|---|---|
| 890,563 | 6/1908 | Jones | 75/91 |
| 900,346 | 10/1908 | Benjamin | 75/91 |
| 3,700,431 | 10/1972 | Themelis et al. | 75/76 |

FOREIGN PATENT DOCUMENTS

| | | | |
|---|---|---|---|
| 494,271 | 7/1950 | Belgium | 75/3 |
| 2,243,194 | 3/1973 | Germany. | |

OTHER PUBLICATIONS

Chemical Abstracts, vol. 80, No. 24, paragraph 136,072j (1974).

*Primary Examiner*—L. Dewayne Rutledge
*Assistant Examiner*—Michael L. Lewis
*Attorney, Agent, or Firm*—Mallinckrodt & Mallinckrodt

[57] ABSTRACT

Impure copper precipitates, obtained by cementation of copper from an aqueous solution, are converted into dense, unfriable, high-grade copper pellets suitable for separate smelting and refining as well as for being fed directly to anode or refining furnaces. Sufficient water is added to the copper precipitates to form a coherent, moldable mass of moist precipitates, which is then formed into pellets. The pellets are dried, and then heated to a sintering temperature of at least 750° C. in a reducing atmosphere. The pellets are held at the sintering temperature for a time sufficient to form dense, unfriable, high-grade copper pellets, and the high-grade pellets are then cooled to near ambient temperature before being exposed to an oxidizing atmosphere such as air.

11 Claims, 1 Drawing Figure

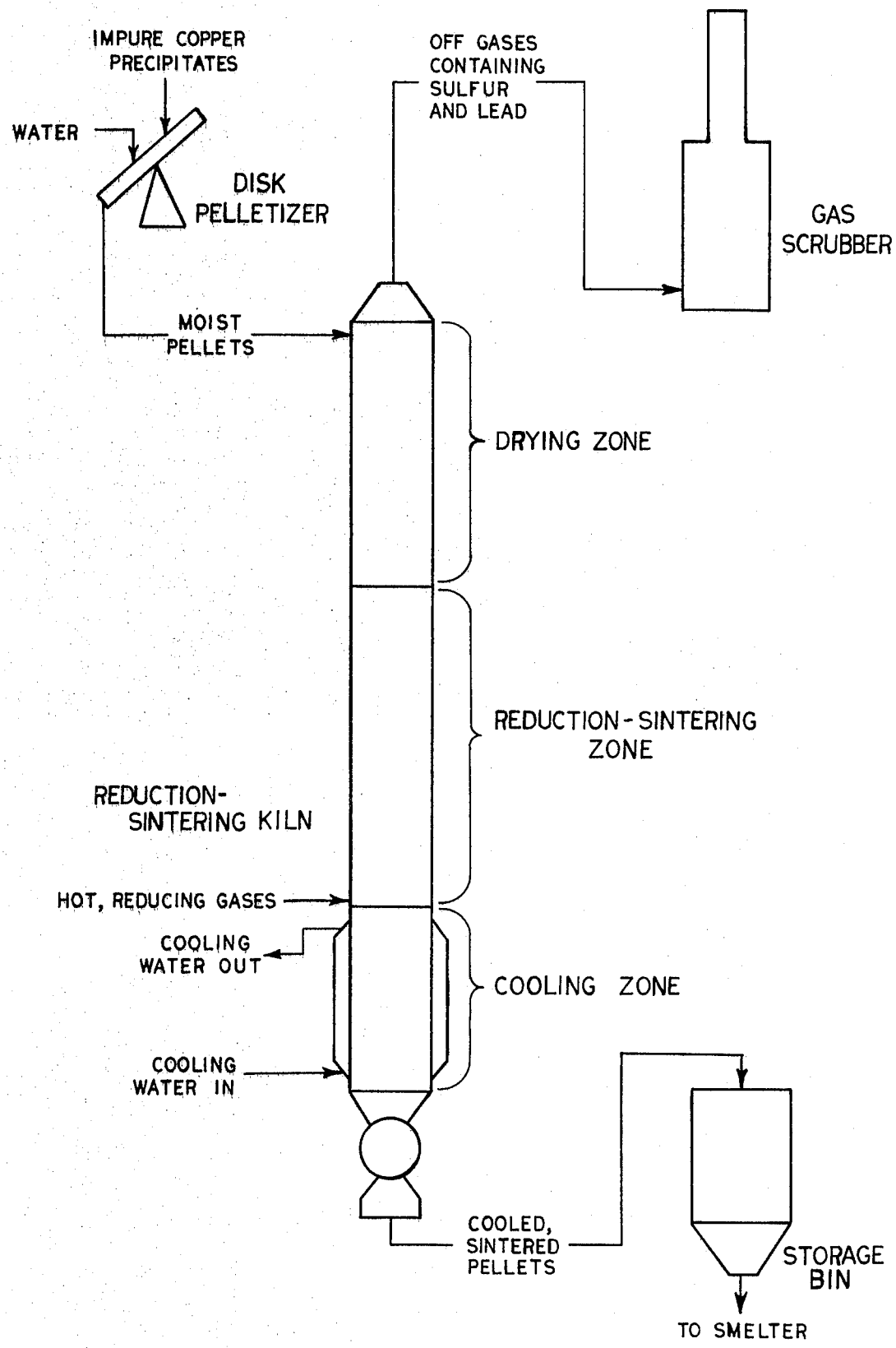
IMPURE COPPER PRECIPITATES
WATER
DISK PELLETIZER
OFF GASES CONTAINING SULFUR AND LEAD
GAS SCRUBBER
MOIST PELLETS
DRYING ZONE
REDUCTION-SINTERING ZONE
REDUCTION-SINTERING KILN
HOT, REDUCING GASES
COOLING WATER OUT
COOLING ZONE
COOLING WATER IN
COOLED, SINTERED PELLETS
STORAGE BIN
TO SMELTER

COPPER PRECIPITATE AGGLOMERIZATION PROCESS

RELATED APPLICATION

This application is a continuation-in-part of application Ser. No. 638,022, filed Dec. 5, 1975, which was abandoned in favor of this application.

BACKGROUND OF THE INVENTION

Field

This invention relates to techniques for producing an agglomerated product from impure copper precipitates, and in particular, an agglomerated product suitable for separate smelting and refining.

State of the Art

In cementation of copper values from an aqueous solution, the copper precipitates are deposited in the form of a sludge, and the mother liquor is separated from the precipitates by draining and/or filtering. The moist precipitates are conventionally blended with flotation concentrates and fed to a reverberatory furnace.

Agglomerating and briquetting of various smelter feeds has been recognized as a viable technique for reducing material loss and for providing convenient handling and rapid smelting. However, several problems have been encountered in the agglomerization and smelting of copper precipitates. Agglomerates, i.e., pellets, nodules, or briquettes, made from moist copper precipitates oxidize very rapidly when exposed to air. The oxidation reaction elevates the temperature of stored agglomerates to a red heat, and the "burning" agglomerates constitute a fire hazard. In addition, the copper agglomerates contain large amounts of oxygen and sulfur and are not suitable for conventional smelting and refining processes. Simple smelting of the agglomerated precipitate copper results in the generation of slag containing a high content of copper oxide. A more complex smelting process must be used wherein reducing agents are added to the charge to control the amount of copper oxide in the slag. The complex smelting processes are far more costly than conventional smelting techniques, and have never been of commercial significance.

The present invention provides a process of economically producing agglomerated copper precipitates which can be smelted and refined by conventional smelting and refining techniques. In fact, the agglomerates produced by this invention are suitable for being fed directly to anode or refining furnaces.

SUMMARY OF THE INVENTION

In accordance with the invention, impure copper precipitates, containing from about 65 to over 95 percent by weight copper, from about 1 to 15 percent by weight oxygen (principally as copper oxide, i.e. $Cu_2O$), and from about 0.1 to 2 percent by weight sulfur are thoroughly mixed with sufficient water to provide a coherent, moldable mass of moist precipitates having sufficient green strength for shape retention, and the moist precipitates are formed into pellets. The term "pellets," as used throughout the specification and claims, is meant to encompass any agglomerated, shaped mass including conventional spherically shaped pellets as well as cylindrically shaped pellets, nodules, briquettes, etc.

The resulting green pellets are dried, preferably in a neutral or a reducing atmosphere, and the dried pellets are heated in a reducing atmosphere to a sintering temperature of at least 750° C. The pellets are held at the sintering temperature for a time sufficient to (1) reduce copper oxides in the pellets to metallic copper, (2) to volatilize sulfur and lead impurities therefrom, and (3) to sinter the metallic copper in the pellets. The hot, sintered pellets are cooled in a neutral or reducing atmosphere to a temperature below about 150° C.

After being cooled, the pellets are essentially inert and can be exposed to air for indefinite periods of time without any adverse effects. The pellets are dense, uncrushable and extremely resistant to attrition in handling. They are high-grade pellets which contain at least about 75% copper, and as much as about 95% copper depending upon the copper content of the feed precipitates. The pellets contain no more than about 1% oxygen by weight as copper oxides and no more than about 0.1% sulfur by weight. The pellets behave like copper shot when melted in a furnace, i.e., they are readily digested.

Preferably, the drying of the green pellets and the subsequent heating of the dried pellets are accomplished in an elongate kiln. The green pellets are introduced into the kiln at one end and conveyed through the kiln to the other end. The pellets are contacted with a stream of hot reducing gases which are passed through the kiln in the opposite direction to that of the pellets. The temperature of the hot reducing gases is such that the pellets are initially heated and dried and then progressively heated to the sintering temperature as they move through the kiln. The kiln is of sufficient length for the pellets to be maintained at the sintering temperature for about 5 to 30 or more minutes, i.e. a time sufficient for sintering of the pellets. Reduction of the copper oxides contained in the green pellets and the volatilization of sulfur and lead from same occur rapidly at the temperatures employed, and it has been found that these reactions are essentially completed within the time required for sintering the pellets.

The reducing atmosphere which is maintained about the pellets preferably comprises a gas selected from the group consisting of carbon monoxide, hydrogen, and mixtures thereof. Advantageously, the reducing atmosphere is generated by the controlled combustion of fuel such as oil, natural gas, propane, or coal. The heat of combustion of the fuel, together with the exothermic heat derived from the reduction of copper oxide in the pellets supply essentially all the process heat required.

The process provides for flexibility in the processing of impure copper precipitates. Fresh, dewatered precipitate copper has a typical oxygen content of from about 2 to 11 percent by weight. Upon exposure to air, the precipitates are readily oxidized to an oxygen content of from about 6 to 15 percent by weight. This high oxygen content together with sulfur and lead impurities contained in the precipitates are responsible for many of the difficulties previously encountered in smelting and refining precipitate copper. Copper oxides contained in the impure precipitate are readily reduced to metallic copper during the heat treatment and sintering of the green pellets. In addition, sulfur and lead impurities are also removed from the precipitate copper during the sintering of the pellets.

THE DRAWING

The single FIGURE of the drawing is a flowsheet representing the best mode presently contemplated for carrying out the invention.

DETAILED DESCRIPTION OF THE ILLUSTRATED EMBODIMENT

As illustrated, impure copper precipitates, obtained from cementation of copper from an aqueous solution with metallic iron, are mixed with water in a conventional disc pelletizer to form shape-retaining pellets. Water is added to the precipitates in an amount necessary to form a coherent, moldable mass which can be formed into the shape-retaining pellets having sufficient strength and coherency to withstand subsequent handling during the drying thereof. Preferably, enough water is added to the precipitates so that the moist mass contains from about 10–25 percent water by weight.

The moist, uncured pellets, i.e., green pellets, are dried, and the dried pellets are subsequently subjected to a heat treatment in the presence of a reducing atmosphere. The drying of the green pellets can be accomplished in any conventional drying apparatus, such as traveling grate, horizontal belt, disc, tray, and hollow screw driers as well as vertical kilns and horizontal rotary kilns.

The dried pellets are then heated in a reducing atmosphere to a sintering temperature of at least 750° C for a time sufficient to (1) reduce copper oxides in the pellets to metallic copper, (2) volatilize sulfur and lead impurities from the pellets, and (3) sinter the metallic copper in the pellets, thereby forming dense, unfriable, copper pellets. Pellets containing from about 75% to 95%, or greater by weight are produced from corresponding precipitates containing from about 65% copper to about 75% copper by weight, respectively. The pellets contain no more than about 1 percent by weight oxygen in the form of copper oxides.

The drying of the pellets and the subsequent heat treatment of the dried pellets can be advantageously accomplished in an elongate kiln through which the pellets pass. The kiln can be of the rotary, horizontal type or, as shown in the drawing, of the vertical, shaft type kiln. In either apparatus, the green pellets are introduced at one end of the kiln and pass through the kiln in counterflow relation to hot process gases which are either introduced into or generated at the other end of the kiln.

As shown in the drawing, the green pellets are introduced at the upper end of the kiln and pass therethrough under the force of gravity. The green pellets initially pass through a drying zone wherein they are contacted with hot process gases coming from the reduction-sintering zone. As the pellets progress through the drying zone, they are progressively dried and heated by the counterflow of process gases.

The dried pellets continue to move through the kiln into the reduction-sintering zone wherein they are progressively heated to a temperature of at least 700° C., preferably between about 750° and about 950° C. The pellets are maintained at this temperature for a time sufficient to reduce the copper oxides contained therein to metallic copper and to sinter the pellets. Sulfur and lead impurities are volatilized and removed from the pellets during the heat treatment.

The hot process gases flowing countercurrent of the pellets in the reduction-sintering zone must have reducing characteristics. The reducing gases preferably contain CO and/or $H_2$ in mixture with inert gases such as $CO_2$, $H_2O$, and nitrogen. Hot, reducing gases can be supplied by burning a fuel with a sub-stoichiometric air supply. The temperature of the hot, reducing gases should be no greater than about 950° C to avoid melting the pellets in the vicinity of the gas inlet. The temperature of the gases can be controlled by injecting cooling water into the gases prior to contact of the gases with the pellets in the kiln. The hot gases flow through the kiln countercurrent to the movement of pellets.

The oxygen content of dewatered, precipitate copper obtained by cementation of copper from aqueous solutions ranges from about 2% to 11% or more. Upon standing and exposure to air, the precipitates are readily oxidized, and the oxygen content of the precipitates rapidly increases to about 6% to 15% by weight. It is this high oxygen content which is responsible for many of the difficulties previously encountered in processes for smelting and refining precipitates.

The reducing gases rapidly react with the copper oxides contained in the pellets as the pellets pass through the reduction-sintering zone of the kiln. Depending on the reducing gas being used, the reduction of copper oxides proceeds according to the following reactions:

$$Cu_2O + H_2 \rightarrow 2Cu + H_2O$$

$$CuO + H_2 \rightarrow Cu + H_2O$$

$$Cu_2O + CO \rightarrow 2Cu + CO_2$$

$$CuO + CO \rightarrow Cu + CO_2$$

Unlike similar reactions involving ferrous oxide, the above reactions are stoichiometric, i.e., the reactions go to completion.

Solid and liquid carbonacious materials can also be used as a reductant. Such materials can be suspended in the hot gases which are introduced into the reduction-sintering zone of the kiln, or they can be introduced into the reduction-sintering zone as an admixture with the dried pellets. Carbonaceous materials, such as hydrocarbon fuels and carbon itself, do not reduce copper oxides, but, instead, reduce water to $H_2$ and CO and reduce $CO_2$ to CO in a reductant regeneration reaction. When a solid carbonaceous reductant is used, it is preferable to mix it with the moist precipitates during the formation of the green pellets. However, the solid reductant can also be mixed with the pelleted precipitates at any time following the formation of the pellets and prior to the reduction and sintering of the pellets.

The copper oxides in the pellets are rapidly reduced at the temperatures employed in the reduction-sintering zone of the kiln, and it has been found that the reduction is not limited, at normal operating conditions, by diffusion of the reducing gases into the pellets or of the products out of the pellets. From a practical standpoint, if an adequate quantity of reductant is present during the reduction-sintering stage, i.e. at least stoichiometric amounts of reductant, the copper oxide reduction is completed well within the time required to sinter the pellets.

The reduction of the copper oxides in the pellets is exothermic and supplies a major portion of the process heat for the drying and sintering of the pellets. Additional process heat is supplied by the heat content of the hot, reducing gases being introduced into the kiln. Advantageously, the hot, reducing gases are produced by the combustion of fuel with a substoichiometric air supply. Such combustion produces hot gases containing substantial amounts of CO, $H_2$ and carbon. Depending on the oxide content of the pellets and the amount of reductants introduced into the reduction-sintering zone, the gases being introduced to such zone may need to be diluted with an inert or neutral gas or other inert cooling medium to avoid overheating the pellets in the reduction-sintering zone. If dilution is necessary this can be attained by injecting water, steam, or an inert gas such as nitrogen or carbon dioxide into the reduction-sintering zone of the kiln.

In addition to the reduction of copper oxides to metallic copper, the heat treatment of the present process results in effective removal of substantial amounts of sulfur and lead impurities from the pellets. The amount of sulfur and lead contained in typical copper precipitates ranges up to about 1% for sulfur and up to about 0.4% for lead. Up to 90% or more of the sulfur and up to 65% or more of the lead is removed from the pellets during the heat treatment of this invention. The off-gases from the kiln are treated in conventional scrubber apparatus to remove sulfur, lead, and other impurities which accumulated therein during the heat treatment of the pellets, and the gases are then released to the atmosphere.

The sintered pellets leaving the reduction-sintering zone must be cooled to near ambient temperatures before they are exposed to air or other gases containing oxygen or an oxidizing agent. This cooling can be accomplished in a variety of ways, but in all cases, a gas seal must be provided to prevent air infiltration to the reduction-sintering zone, or to the hot, sintered pellets coming therefrom prior to their cooling to near ambient temperature.

As shown in the drawing, it is convenient to incorporate a cooling zone as an integral portion of the vertical shaft kiln so that the sintered pellets pass directly from the reduction-sintering zone into the cooling zone. As shown, the cooling zone can be formed by providing a cooling water jacket around the appropriate section of the vertical shaft kiln. The pellets pass through the cooling zone, and the cooled pellets are removed from the vertical shaft kiln through an air lock feeder. The cooled pellets are then transferred to appropriate storage means prior to their being transported to a smelter or refinery. Instead of the indirect cooling which is illustrated, the pellets could be cooled directly using water sprays or inert gas cooling.

The invention will be further described with reference to the following examples; however, the examples are intended to illustrate the invention and are not to be construed to limit the scope of the invention.

EXAMPLE 1

Precipitate copper obtained from cementation of copper from aqueous leach solutions was mixed with sufficient water to provide a coherent, moldable mass of moist precipitates. The moist material was formed into wet balls on a conventional pelletizing disc. The resulting pellets (green wet balls) were dried in a low temperature drying oven.

A portion of the dried precipitate pellets weighing 177 grams was placed in a stainless steel boat. The boat was placed in an electric resistance furnace maintained at 800° C by an electronic controller. Immediately upon placing the pellets in the furnace, natural gas (94% methane) was introduced into the furnace. The flow of natural gas was maintained to produce a short (2 in.) flame at the end of a 7 mm diameter ceramic vent tube located on the furnace. After 30 minutes, the natural gas was shut off and pure nitrogen introduced into the furnace. The pellets were drawn into a water-cooled section of the furnace tube shell where they were rapidly cooled to room temperature. The pellets weighed 138 grams. The pellets were hard and could only be broken by striking with a hammer.

A series of tests similar to the above was conducted using various furnace temperatures and heating times. The composition of the resulting product pellets is shown in Table 1 as compared to the composition of the dried feed pellets prior to the heating and sintering thereof.

| | | % Cu | %S | %O | Time Min. | Temp., ° C |
|---|---|---|---|---|---|---|
| Dried feed pellets | | 80.7 | .65 | 12.14 | — | — |
| Product From Test 1 | | 95.0 | .17 | 1.16 | 5 | 800 |
| | 2 | 95.8 | .05 | .806 | 10 | 800 |
| | 3 | 95.8 | .06 | .757 | 30 | 800 |
| | 4 | 95.4 | .07 | .814 | 5 | 850 |
| | 5 | 96.2 | .04 | .643 | 10 | 850 |
| | 6 | 94.9 | .06 | .631 | 30 | 850 |
| | 7 | 95.5 | .06 | .715 | 5 | 900 |
| | 8 | 94.6 | .08 | .640 | 10 | 900 |
| | 9 | 94.8 | .09 | .631 | 30 | 900 |

EXAMPLE 2

Precipitate copper was pelletized on a disc pelletizer to produce wet balls, having a size of about ¼ to 7/16 inch. The balls were screened to remove the −8 mesh fraction and then charged to an indirect fired rotary kiln. The kiln was heated to 860° to 900° C by natural gas burners and the discharge end was cooled by water sprays. The kiln was rotated at a speed of between 1.5 to 3 rpm. Natural gas was injected into the inside of the kiln shell at a rate sufficient to produce a natural gas flame 1 inch long at the kiln discharge. Approximately 68 lbs. of the wet precipitate balls were charged to the kiln over a time period of 1 hour and 10 minutes. The kiln product was dense and essentially unbreakable. The average residence time of the balls in the kiln was 15 minutes. The composition of the sintered product is shown in Table 2 as compared to the composition of the material which was fed to the rotary kiln.

TABLE 2

| | % | | | |
|---|---|---|---|---|
| | Cu | Fe | S | O |
| Feed | 85.2 | 1.7 | .46 | 7.67 |
| Product | 95.6 | 1.6 | .014 | 1.05 |

EXAMPLE 3

Precipitate pellets, as prepared by the method described in Example 1, were charged to a vertical tube furnace 2 inch ID by 24 inch high that had been preheated to 700° C. The bed occupied approximately 8 inches of the furnace. Upon charging, the furnace temperature controller was increased to 850° C and hydrogen gas was simultaneously introduced into the bottom of the furnace at about 2.5 liters per minute. The off-gases from the furnace were vented through a ceramic tube 7 mm in diameter. The gas was continuously tested for flammability. The off-gas ignited after 20 minutes.

This corresponded to completion of the reduction reaction. The hydrogen flow was stopped, the furnace power shut off, and the charge rapidly cooled with an inert gas flow. The pellets were removed from the furnace and quenched in water. The resulting pellets were dense and essentially unbreakable. They were in all respects similar to the product of Example 2.

I claim:

1. A process for treating impure copper precipitates, containing from about 65 to over 95 percent by weight copper, from about 1 to 15 percent by weight oxygen, and from about 0.1 to 2 percent by weight sulfur, said oxygen and sulfur being chemically combined with the copper in the precipitates, to produce high-grade copper pellets suitable for being fed directly to smelting and refining furnaces, said process comprising mixing the precipitates with sufficient water to form a coherent, moldable mass of moist precipitates; forming pellets from the moist precipitates; drying the so-formed pellets; heating the dried pellets in a reducing atmosphere to a sintering temperature of at least 700° C, for a time sufficient to form dense, unfriable, high-grade, copper pellets containing at least about 75 percent by weight copper and having no more than about 1.0 percent by weight oxygen in the form of copper oxides and 1 percent by weight sulfur; and cooling the high-grade copper pellets in an inert or reducing atmosphere to a temperature below about 150° C.

2. A process in accordance with claim 1, wherein sufficient water is mixed with the precipitates so that the pellets formed therefrom have sufficient green strength and coherency to withstand handling during the subsequent drying.

3. A process in accordance with claim 1, wherein sufficient water is mixed with the precipitates so that the moist precipitates contain from about 10 to 25 percent water.

4. A process in accordance with claim 1, wherein the sintering temperature is from about 750° C to about 950° C.

5. A process in accordance with claim 1, wherein the reducing atmosphere comprises a gas selected from the group consisting of hydrogen, carbon monoxide, and mixtures thereof.

6. A process in accordance with claim 1, wherein a solid carbonaceous reductant is present with the pellets during the heat treatment, and at least a portion of the reducing atmosphere comprises a reducing gas which is generated in-situ by the carbonaceous reductant during the heat treatment.

7. A process in accordance with claim 6, wherein the solid carbonaceous reductant is added to the moist precipitates from which said pellets are formed.

8. A process in accordance with claim 1, wherein drying of the pellets is accomplished by heating the pellets in a reducing atmosphere.

9. A process in accordance with claim 8, wherein the drying and heating of the pellets formed from the moist precipitates are accomplished by conveying the pellets through an elongate kiln, and contacting the advancing pellets in said kiln with a stream of hot reducing gas passing through said kiln in a direction opposite that of the pellets, said hot reducing gas having a temperature sufficient so that as the pellets advance through the kiln, they are initially heated and dried and then further heated to the sintering temperature.

10. A process in accordance with claim 9, wherein the kiln is a rotary kiln.

11. A process in accordance with claim 9, wherein the kiln is disposed vertically, the moist pellets are introduced at the top end of the kiln and move through the kiln under the force of gravity, and the hot reducing gases are introduced at the other end of the kiln under sufficient pressure that they flow upwardly through the descending pellets.

* * * * *